US008263008B2

(12) United States Patent
Hedrick et al.

(10) Patent No.: US 8,263,008 B2
(45) Date of Patent: Sep. 11, 2012

(54) APPARATUS FOR IMPROVING FLOW PROPERTIES OF CRUDE PETROLEUM

(75) Inventors: Brian W. Hedrick, Oregon, IL (US); Daniel B. Gillis, Arlington Heights, IL (US)

(73) Assignee: UOP LLC, Des Plaines, IL (US)

( * ) Notice: Subject to any disclaimer, the term of this patent is extended or adjusted under 35 U.S.C. 154(b) by 335 days.

(21) Appl. No.: 12/337,734

(22) Filed: Dec. 18, 2008

(65) Prior Publication Data

US 2010/0158764 A1 Jun. 24, 2010

(51) Int. Cl.
*F27B 15/08* (2006.01)
*C10G 57/00* (2006.01)

(52) U.S. Cl. ..... 422/144; 422/134; 422/147; 422/187; 208/67; 208/85; 208/88

(58) Field of Classification Search ..... 422/134, 422/144, 147, 187; 208/67, 85, 88
See application file for complete search history.

(56) References Cited

U.S. PATENT DOCUMENTS

| | | | | |
|---|---|---|---|---|
| 3,430,418 | A | 3/1969 | Wagner | |
| 4,206,038 | A * | 6/1980 | Smith et al. | 208/113 |
| 4,476,094 | A | 10/1984 | Carson | |
| 4,966,680 | A | 10/1990 | Avidan et al. | |
| 5,069,775 | A | 12/1991 | Grosboll | |
| 5,811,608 | A | 9/1998 | Stine et al. | |
| 6,075,173 | A | 6/2000 | Chodorge et al. | |
| 6,080,903 | A * | 6/2000 | Stine et al. | 585/514 |
| 6,166,279 | A | 12/2000 | Schwab et al. | |
| 6,264,828 | B1 | 7/2001 | Baker et al. | |
| 6,946,016 | B2 * | 9/2005 | Reddy | 95/96 |
| 2006/0042999 | A1 | 3/2006 | Iqbal et al. | |
| 2006/0144754 | A1 * | 7/2006 | Van Den Bosch et al. | 208/92 |
| 2007/0017851 | A1 | 1/2007 | Mehra et al. | |
| 2007/0034550 | A1 | 2/2007 | Hedrick et al. | |

FOREIGN PATENT DOCUMENTS

| | | | |
|---|---|---|---|
| CA | 0907559 | A1 | 8/1972 |
| CA | 2316416 | A1 | 9/2001 |
| EP | 0171460 | A1 | 2/1986 |
| EP | 0787787 | A2 | 8/1997 |
| WO | WO 2005/073346 | A1 | 8/2005 |

OTHER PUBLICATIONS

U.S. Appl. No. 12/337,728, filed Dec. 18, 2008, Hedrick et al.
Toman, "Hydrogen Management in the Upgrading of Heavy Crudes from the Orinoco Oil Belt", Rev. Tec. Intevep 1 (2) : 175-180, Jul. 1981.
Zhou et al., "Pure Hydrogen from the Dry Gas of Refineries Via a Novel Pressure Swing Adsorption Process", Ind. Eng. Chem. Res. 2002, 41, 5290-5297.

(Continued)

*Primary Examiner* — Walter D Griffin
*Assistant Examiner* — Lessanework Seifu
(74) *Attorney, Agent, or Firm* — James C Paschall

(57) ABSTRACT

A process and apparatus for improving flow properties of crude may include processing a first crude stream, which may in turn include cracking the first crude stream with catalyst to form a cracked stream and spent catalyst, hydrotreating a portion of the cracked stream and then mixing the hydrotreated stream with an unprocessed second crude stream.

20 Claims, 3 Drawing Sheets

OTHER PUBLICATIONS

Maciula, "Purify Hydrogen for Heavy Oil Processing", Proceedings—Refining Department, American Petroleum Institute (1980), 59, 212-19.

Ovalles, "Thermal and Catalytic Upgrading of Extra Heavy Crude . . . ", UNITAR "Heavy Crude and Tar Sands" 6th Int'l Conf (Houston, Feb. 12-17, 1995) Proceedings V2 473-76 (1995).

Cai, "Processing and Comprehensive Utilization of FCC Dry Gas", Lianyou Sheji (2000), 30(6), 35-38.

Wang et al., "Study on Using FCC Dry Gas for Hydrogen Production and Its Commercial Application", Petroleum Processing and Petrochemicals 33/9 18-21 (2002): ISSN: 1005-2399.

Li, "Upgrading Heavy Oil by Using of Methane as Hydrogen Resource", Shiyou Yu Tianranqi Huagong (2002), 31(3), 138-139.

* cited by examiner

APPARATUS FOR IMPROVING FLOW PROPERTIES OF CRUDE PETROLEUM

BACKGROUND OF THE INVENTION

The field of the invention is improvement of the flow properties of crude petroleum.

RELATED PRIOR ART

When drilling for oil in remote places, considerable expense is associated with transporting the crude oil from the wellhead to a receiving facility. One difficulty of transporting crude oil is that certain crude oils may contain a significant quantity of wax, which has a high boiling point. The temperature at which the wax gels is the pour point. The temperature at which the wax solidifies is the cloud point. In instances where the cloud point or the pour point of a waxy crude oil is higher than the ambient temperature, the likelihood of wax solidification and buildup is a serious threat to a continuous transportation of crude oil. Clearing a pipeline that has become clogged with wax or gelled crude is very expensive and time-consuming.

Another specification for pipeline pumpability is the viscosity of the oil. The viscosity of the oil is proportional to the duty required to pump it. Hence, each pipeline has a viscosity, API and pour point specification. For example, to be accepted for shipment in the Enbridge Pipeline system in Canada and the U.S., the viscosity specification is 350 Centistokes (cSt) at the pipeline operating temperature, which varies seasonally.

Still another specification for pipeline pumpability is American Petroleum Institute (API) gravity index. Crude oil is often described in terms of "lightness" or "heaviness" by the API gravity index. A high number denotes a "light" crude, and a low number denotes a "heavy" crude.

A petroleum product with good flow properties such as low pour point, high API gravity, and low viscosity is desired by refiners.

FCC is a catalytic process for converting heavy hydrocarbons into lighter hydrocarbons by contacting the heavy hydrocarbons in a fluidized reaction zone with a catalyst absent substantial added hydrogen. Most FCC units now use zeolite-containing catalyst having high activity and selectivity. As the cracking reaction proceeds, substantial amounts of highly carbonaceous material referred to as coke are deposited on the catalyst, forming spent catalyst. High temperature regeneration burns coke from the spent catalyst. Spent catalyst is continually removed from the reaction zone and replaced by essentially coke-free regenerated catalyst from the regeneration zone.

US 20070034550 A1 teaches subjecting a portion of a crude stream to FCC and mixing a portion of the cracked stream with a second crude stream to facilitate pipeline transport. We have found that crudes subjected to FCC can produce olefins and diolefins in the gasoline and lighter portions of the product which are believed to cause fouling of heat exchangers and other equipment at the refinery end of the pipeline. A system for extracting and transporting crude oil from a remote field while maintaining a sufficiently low concentration of olefins and diolefins would be desirable.

Hydrotreating is a process in which hydrocarbon feeds are contacted with catalyst in the presence of added hydrogen to saturate olefins and diolefins and/or desulfurize organic sulfur. Hydrotreating is performed at elevated temperature and pressure. Hydrotreating cannot be performed without a source of hydrogen.

SUMMARY OF THE INVENTION

We have discovered a process and apparatus for preparing crude streams for pipe transport with sufficiently low olefin concentration. Hydrogen in the cracked product is used to hydrotreat a portion of the cracked hydrocarbon product to saturate problematic olefins over a hydrotreating catalyst. In one aspect of the invention, dry gas is separated from the FCC products and used for hydrotreating another portion of the FCC product to saturate problematic olefins. In a further aspect, the dry gas is purified to provide a sufficiently hydrogen-rich stream for hydrotreating the other portion of the FCC product. In an even further aspect, olefins in an LPG portion of the FCC product are oligomerized and hydrotreated. The hydrotreated streams may be blended with an unprocessed crude stream to prepare the unprocessed crude stream for pipeline transportation.

DETAILED DESCRIPTION OF THE INVENTION

This invention may improve the flow properties of a crude petroleum stream. The process makes cutter stock from a portion of a crude oil using modularly designed components. Crude oil may comprise the crude feed to be catalytically cracked by a fluidized catalytic cracking (FCC) process and the product may be mixed with unprocessed crude oil to create a blend of processed and unprocessed crude to improve the flow properties of the crude by lowering the crude pour point, raising the API and/or reducing the viscosity for easing transportation of the blended product through a pipeline to a location remote from the oil field for further processing.

Residual fluidized catalytic cracking (RFCC) may be used to process Conradson carbon residue and metals-contaminated feedstocks such as atmospheric residues or mixtures of vacuum residue and gas oils. Depending on the level of carbon residue and nickel and vanadium contaminants, it is contemplated that these feedstocks may be hydrotreated or deasphalted before being fed to an RFCC unit.

Crude oil from a source may comprise all or part of a crude feed stream to be processed by FCC. Crude feed processed by this invention may be heavy hydrocarbon comprising heavy oil or bitumen. Whole bitumen may include resins and asphaltenes, which are complex polynuclear hydrocarbons, which add to the viscosity of the crude oil and increase the pour point. Crude feed may also include conventional crude oil, atmospheric tower bottom products, vacuum tower bottoms, coal oils, residual oils, tar sands, shale oil and asphaltic fractions.

Heavy crude oil is typically very viscous, having a API gravity of between about 8 and about 13 API. Waxy crudes typically have a higher API in excess of 25, but a pour point of between about 20° and 50° C. Viscosity of crude oil may be between about 10,000 and about 15,000 cSt at about 40° C. Crude oil may be characterized as a hydrocarbon stream having properties in at least one of the following ranges: pour point of greater than about 20° C., viscosity greater than about 10,000 cSt at about 38° C. (100° F.) and an API gravity typically greater than 18 API.

Processing Apparatus

Figure 1:
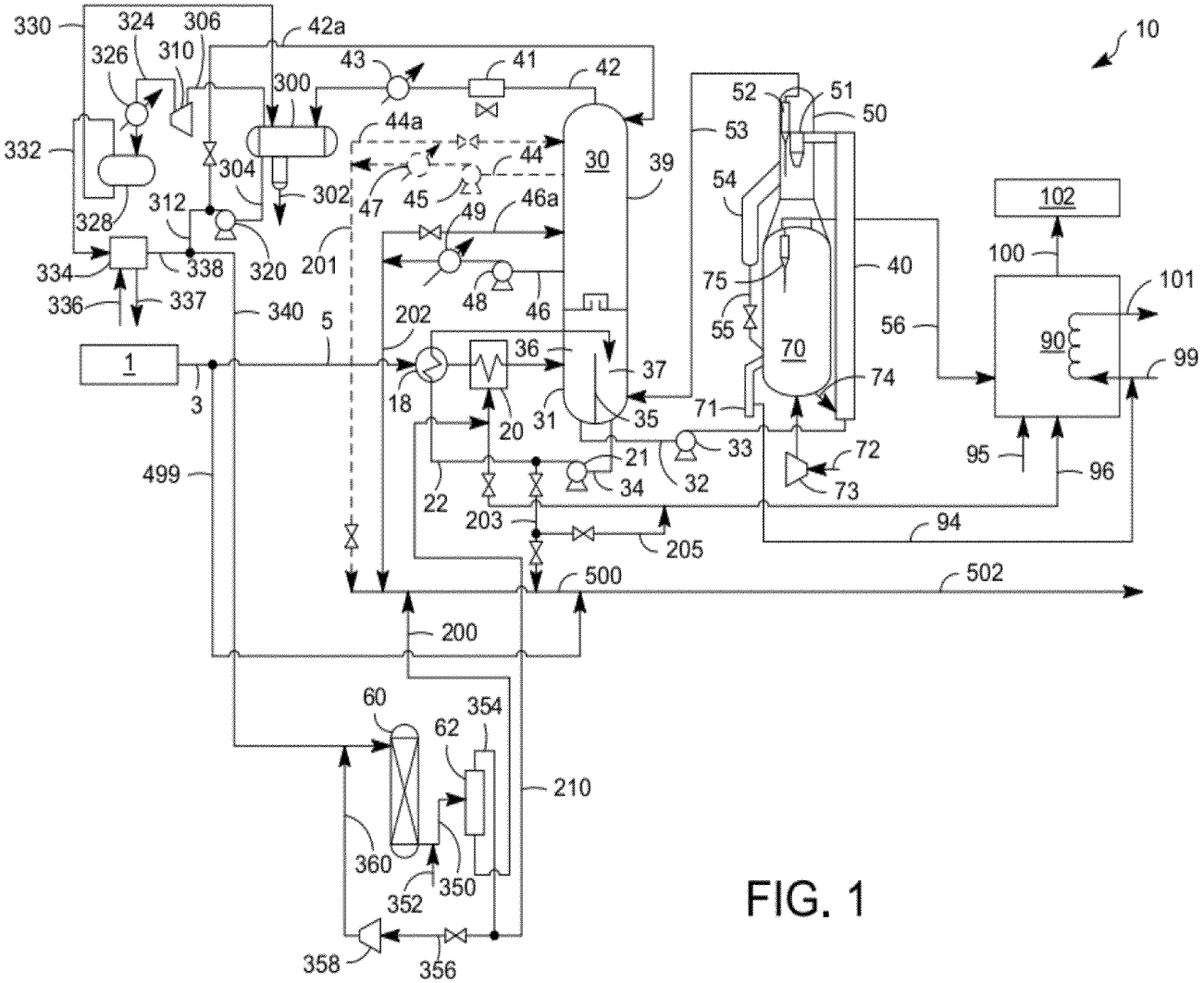
FIG. 1 is a flow scheme showing a process and apparatus of the present invention.

Referring to FIG. 1, apparatus 10 delivers a crude oil stream from the oil field ground 1 in line 3. The crude oil stream in line 3 is typically subjected to heating and separation of an oil phase from a water phase to dewater the crude oil stream in line 3. The crude oil stream in line 3 is separated into two portions. A first crude stream is carried in line 5 for processing while a second crude stream is carried in line 499 to bypass the processing of line 5. The first and second crude streams in lines 5 and 499, respectively, will have the characteristics of crude oil given above. The crude oil may be sent to a fired heater 20 where the crude oil may be preheated. Optionally, the crude oil in line 5 may also be heated in heat exchanger 18 by indirect heat exchange with bottoms recycle in line 22. After leaving heater 20, the heated crude oil may be introduced into lower portion 31 of fractionator 30. In some FCC processes, the first crude stream in line 5 is not directed to fractionator 30 but may instead be introduced directly to riser 40 for catalytic cracking.

The recovery of resids, or bottom fractions, involves selective vaporization or fractional distillation of the crude oil with minimal or no chemical change in the crude oil. The fractionating process may provide a feed stock more suitable for FCC processing. The selective vaporization of the crude oil takes place under non-cracking conditions, without any reduction in the viscosity of the feedstock components. Light hydrocarbons, those boiling below about 700° F. (about 371° C.), preferably those boiling below about 675° F. (about 357° C.), and most preferably those boiling below about 650° F. (about 343° C.), are flashed off of the crude oil in feed zone 36. The light hydrocarbons typically are not catalytically cracked. Hence, the feed zone 36 serves as a stripper in which light hydrocarbons are stripped from the crude feed to provide a stripped first crude stream in FCC feed line 32.

The first crude feed stream 5 may be fed directly to a riser 40 of an FCC unit without the fractionating step, depending on the quantity of light ends, gasoline, gas oils and residuals. Direct feeding would be desirable if the quantity of hydrocarbons boiling below about 650° F. (about 343° C.) is relatively low and their segregation therefore unnecessary. The bottoms product of fractionator 30, in feed zone 36 comprising a stripped first crude stream is withdrawn via FCC feed line 32 and directed by pump 33 to a bottom of the riser 40.

The feed rate to apparatus 10 may be between about 5,000 and about 200,000 barrels per day, preferably between about 25,000 and about 150,000 barrels per day, and more preferably about 100,000 barrels per day although the feed rate could vary from these ranges. Feed to the FCC may be between 10 LV-% and about 60 LV-% of the complex charge in line 3 from the oil field 1 with lower rates being preferable to higher rates unless utility balances require higher charge rates. The stripped first crude stream in line 32 is contacted with catalyst in the riser 40 perhaps in the presence of an inert fluidization gas such as steam. The first crude stream is cracked into lighter hydrocarbon products which are carried out of the riser 40 as a cracked stream. The catalyst becomes spent as carbon residue builds up on the catalyst surface. The spent catalyst and the cracked stream exit from the top of riser 40 and into a reactor vessel 50 in downstream communication with the top of the riser 40 optionally through a rough cut separator 51 to separate cracked stream vapors from the spent catalyst. One or more stages of cyclones 52 further separate the spent catalyst from the cracked stream by inducing the mixture of catalyst and cracked stream gases to swirl so that the heavier spent catalyst travels downwardly and the lighter gaseous cracked stream travel upwardly.

Approximate operating conditions include heating the crude feed for catalytic cracking to between about 3000 and about 500° F. (between about 149° and about 260° C.), preferably between about 350° and about 450° F. (between about 1770 and about 232° C.), and more preferably about 400° F. (about 204° C.). The temperature in reactor vessel 50 may be between about 850° and about 1100° F. (between about 454° and about 593° C.), preferably between about 900° and about 1050° F. (between about 482° and about 566° C.), and more preferably between about 950° and about 1000° F. (between about 5100 and about 538° C.). The FCC conversion may be between about 40 and about 80 LV-% to gasoline and lighter products, between about 65 LV-% and about 75% LV-% to gasoline and lighter products, or about 70 LV-% to gasoline and lighter products.

Continuing with FIG. 1, the vapor products exit the top of reactor vessel 50 and may be directed via line 53 to product zone 37 in lower portion 31 of the fractionator 30 in downstream communication with the reactor vessel 50. Heat from product vapors may be absorbed within fractionator 30, so that the vapors are desuperheated and the primary product separation takes place. The heat required for the separation of the products in fractionator 30 is primarily provided by the cracked product stream. Thus, in the case that the crude feed is sent directly to riser 40, no other heat is input to fractionator 30. The fractionation of product fed to product zone 37 may be by heat removal, rather than heat input. The heat may be removed from the fractionator by a series of pump-around exchanger flows coupled with fractionator bottoms steam generation and overhead cooling in the form of an air/water cooled condenser.

FCC Products

Catalysts most appropriate for use in riser 40 are zeolitic molecular sieves having a large average pore size. Typically, molecular sieves with a large pore size have pores with openings of greater than 0.7 nm in effective diameter defined by greater than 10 and typically 12 membered rings. Pore Size Indices of large pores are above about 31. Suitable large pore zeolite components include synthetic zeolites such as X-type and Y-type zeolites, mordenite and faujasite. Y zeolites with low rare earth content may be the preferred catalyst. Low rare earth content denotes less than or equal to about 1.0 wt-% rare earth oxide on the zeolite portion of the catalyst. The catalyst may be dispersed on a matrix comprising a binder material such as silica or alumina and/or an inert filer material such as kaolin. It is envisioned that equilibrium catalyst which has been used as catalyst in an FCC riser previously or other types of cracking catalyst may be suitable for use in the riser of the present invention.

In order to increase hydrogen production in the FCC for saturating olefins, the nickel activity of the catalyst may be optimized by adjusting the concentration of nickel passivation agent, such as antimony, injected with the feed. The nickel serves as a dehydrogenation catalyst under the conditions in the FCC riser 40. Although vanadium is also a dehydrogenation metal, it should be controlled by metal trapping agents, such as a rare earth metal to control vanadic attack on the zeolitic framework.

The FCC system cracks most of the crude feed into material in the $C_5$+ range boiling at 400° F. These products may have an API gravity of between about 30 and about 60, between about 35 and about 55, or between about 40 and about 50, and therefore contribute significantly to the increase in the net API of the blended stream in line 502. Catalytic cracking of the crude oil maximizes the API gravity increase while processing a minimum amount of crude oil.

The combined liquid product from the FCC processing of crude oil may contain converted products from the crude stream and may be transported in line 500. The liquid product from the processing of the crude oil is characterized as having an API gravity of at least about 30, preferably greater than about 35, and more preferably greater than about 37. The liquid products may also have a viscosity of less than about 2 cSt, preferably less than about 1.5 cSt and more preferably less than about 1 cSt at 122° F. (50° C.). The liquid products formed may have a pour point less than about 40° F. (about 4° C.), preferably less than about 30° F. (about −1° C.), and more preferably less than about 25° F. (about −3.8° C.). The combined liquid conversion products from the processing of the heavy oil by FCC are lighter and less viscous by virtue of the reduction in molecular weight. More cracking in the FCC may result in lower viscosity and density of the product.

The exact quantity of feed which is necessary to be processed depends on the specific acceptance requirements of the pipeline for pumpability. These may be specified as maximum density or minimum API gravity, maximum viscosity at a certain temperature, maximum pour point or any combination of these specifications. Any of the aforementioned specifications could be the limiting factor for the amount of processing needed, depending on the crude type or the specification. In addition, the specifications may be different for different times of the year due to changing pipeline operation temperatures. Adjustment of the conversion level of the FCC or of amount processed can be exercised as a convenient way to meet the specifications at minimum operating cost.

The liquid products from the FCC reaction are mixed with a minimally or unprocessed second crude stream in line 499 to form a mixed crude stream suitable for transport in line 502. Between about 5 LV-% and about 60 LV-% of the crude stream in line 3 may be FCC processed and added to the second crude stream in line 499, preferably between about 10 LV-% and about 40 LV-% of crude feed may be processed and added to the crude stream in line 499, more preferably about 30 LV-% of crude feed may be processed and added to the crude stream in line 499. A ratio of the unprocessed crude oil to the liquid products added may be between about 0.5:1 and about 9:1, between about 1:1 and about 4:1, or between about 2:1 and about 3:1. Liquid streams from fractionator 30, may be combined with the unprocessed second crude stream in line 499. Depending on the site requirements or crude grade desired, it may be desirable to burn all or part of the clarified oil in bottoms line 32, to balance the site energy needs or to upgrade the quality of the crude stream in line 500 and/or 502.

Fractionator

Continuing with FIG. 1, the fractionator column 30 may be a divided-wall fractionator with a partition 35 positioned vertically to isolate a feed zone 36 from a product zone 37 at the bottom of the fractionator 30. Partition 35 may be formed of at least one baffle that is generally imperforate (at least about 80% imperforate, preferably about 90% imperforate). Multiple baffles may be used. The crude oil is directed to feed zone 36 and heated to a temperature between about 600° and about 800° F. (between about 315° and about 427° C.), preferably between about 650° and about 750° F. (between about 343° and about 399° C.), and most preferably a temperature of about 700° F. (about 371° C.) at a pressure of between about 5 and about 15 psig (between about 35 and about 103 kPa), preferably between about 7 and about 13 psig (between about 48 and about 90 kPa), and most preferably about 10 psig (about 69 kPa).

Fractionator 30 may condense superheated reaction products from the FCC reaction to produce liquid hydrocarbon products. Fractionator 30 may also provide some fractionation (or stripping) between liquid side stream products. After the vapor products are cooled from temperatures of between about 900° and about 1050° F. (between about 482° and about 966° C.), preferably between about 950° and about 1000° F. (between about 510° and about 537° C.), and more preferably about 970° F. (521° C.) to temperatures of about between about 50° and about 150° F. (between about 10° and about 66° C.), preferably between about 70° and about 120° F. (between about 21° and about 49° C.), and more preferably about 100° F. (about 38° C.), the vapor products are typically condensed into liquid products and the liquid products are transported out of fractionator 30 and directed to mix with the minimally processed or unreacted second crude stream from line 499 in line 500. In the embodiment of FIG. 1, the liquid products taken as cuts from fractionator 30 typically may comprise light cycle oil (LCO) and fractionator bottoms or clarified oil, also known as heavy cycle oil (HCO). In FIG. 1, HCO does not have a separate cut but is collected in the bottoms. The LCO stream in line 46 is withdrawn from the fractionator column 30 by a pump 48 and cooled in steam generator 49. A reflux portion is returned to the column 30 at a higher location via line **46*a*. LCO line 202 takes the remainder to line 500. Lastly, clarified oil is removed in bottoms line 34 from the fractionator column 30 by a pump 21 and a return portion is cooled in a feed heat exchanger 18 and returned to the product zone 37 of the column 30 isolated from the feed side 36 by partition 35. Net bottoms line 203 may take a remainder of the clarified oil to line 500 for blending or be diverted to the CO boiler 90 through lines 205 and 96**.

FIG. 1 shows a further embodiment in phantom in which the fractionator 30 makes a cut between heavy naphtha and light naphtha. The heavy naphtha stream in line 44 may be withdrawn from the fractionator column 30 by a pump 45 and cooled in a boiler feed water preheater 47. A reflux portion may be returned to the column at a higher location via line **44*a*. Heavy naphtha line 201 takes the remainder to line 500 for blending. In this embodiment, only the light naphtha is taken in line 42** for hydrotreating.

Hydrotreating

We have found that the naphtha and lighter FCC product hydrocarbons boiling at or below about 135° to about 177° C. (275° to 350° F.) contain a large concentration of olefins and diolefins which may cause fouling of heat exchanger tubes in a refinery, making the upgraded crude stream problematic. This naphtha cut captures at least 80-90 wt-% of the olefins and rejects much of the organic sulfur that would cause hydrodesulfurization which undesirably consumes hydrogen in a hydrotreating reactor. We propose to hydrotreat the naphtha and/or lighter FCC product hydrocarbons with hydrogen which may be in the dry gas stream to saturate olefins and diolefins. In a simplest embodiment, the entire naphtha and lighter cut of the cracked stream in line 42 is fed to a hydrotreating reactor 60 in downstream communication with the reactor vessel 50 and riser 40. In this embodiment, no heavy naphtha cut is separately taken from the fractionator 30, cooled and pumped around back to the fractionator 30. In this embodiment, the heavy naphtha and lighter materials are removed in the overhead line 42 from the fractionator 30 and cooled in a condenser 41 and perhaps a boiler feed water heater 43. In the alternative embodiment, only the light naphtha cut boiling at or below about 135° to about 177° C. (275° to 350° F.) is taken in line 42. Under both alternative embodiments, the naphtha cut in line 42 is flashed in a receiver 300 from which water may be removed from a boot in line 302. A wet gas stream is taken from the receiver 300 in line 306 and compressed in a compressor 310. The compressor 310 can pressurize the wet gas to about 862 to about 2068 kPa (125 to 300 psia), and preferably about 1448 to about 2000 kPa (210 to 290 psia). The compressed wet gas stream in line 324 may be cooled in heat exchanger 326 and flashed in a flash drum 328. A liquid stream from the flash drum 328 in line 330 is fed to the receiver 300 while a vapor stream in line 332 is fed to an amine absorber 334. A lean aqueous amine scrubbing solution is introduced into absorber 334 via line 336 and scrubs hydrogen sulfide from the compressed vaporized light ends stream. A rich aqueous amine scrubbing solution containing hydrogen sulfide is removed from absorption zone 334 via line 337 and is recovered and perhaps regenerated for recycle. A compressed vaporized light ends stream having a reduced concentration of hydrogen sulfide and carbon dioxide is removed from absorber 334 via line 338. A condensed naphtha stream is taken from the receiver 300 in line 304 and pumped by pump 320 in line 312 into line 338. A reflux portion may be split from line 312 and be returned to the fractionator 30 in line 42*a*. Naphtha line 340 carries the naphtha stream to the hydrotreating reactor 60.

In one embodiment of the present invention, the naphtha and lighter stream in line 340 which may include light or full range naphtha, liquefied petroleum gas (LPG) and dry gas containing hydrogen is introduced into the hydrotreating reactor 60 to saturate the olefins and diolefins present therein. The hydrogen present in the dry gas drives the hydrotreating reaction. Preferred hydrotreating reaction conditions include a temperature from about 260° C. (500° F.) to about 426° C. (800° F.), a pressure of about 862 to about 2068 kPa (125 to 300 psia) and preferably about 1448 to about 2000 kPa (210 to 290 psia) substantially as provided by compressor 310, and a liquid hourly space velocity from about 0.1 hr-1 to about 10 $hr^{-1}$. The mild pressure in the hydrotreating reactor is chosen to just saturate olefins and to avoid hydrodesulfurization of the organic sulfur in the naphtha to conserve hydrogen. If, however, sufficient hydrogen is in the dry gas component of the naphtha stream, pressure can be increased to hydrodesulfurize the naphtha stream if desired.

Suitable hydrotreating catalyst for use in the present invention are any known conventional hydrotreating catalysts and include those which are comprised of at least one Group VIII metal, preferably iron, cobalt and nickel, more preferably cobalt and/or nickel and at least one Group VI metal, preferably molybdenum and tungsten, on a high surface area support material, preferably alumina. Other suitable hydrotreating catalysts include zeolitic catalysts, as well as noble metal catalysts where the noble metal is selected from palladium and platinum. It is within the scope of the present invention that more than one type of hydrotreating catalyst be used in the same reaction vessel. Two or more catalyst beds and one or more quench points may be utilized in the reaction vessel or vessels. The Group VIII metal is typically present in an amount ranging from about 2 to about 20 weight percent, preferably from about 4 to about 12 weight percent. The Group VI metal will typically be present in an amount ranging from about 1 to about 25 weight percent, preferably from about 2 to about 25 weight percent.

The resulting effluent from the hydrotreating reactor 60 in line 350 with a lower concentration of olefins than in the stream in line 340 is preferably contacted with an aqueous stream from line 352 to dissolve any ammonium salts and partially condense the hydrotreating effluent. The hydrotreated effluent in line 350 is then introduced into a high pressure vapor-liquid separator 62 operated at a pressure substantially equal to the hydrotreating reactor and a temperature in the range from about 38° C. (100° F.) to about 71° C. (160° F.). An aqueous hydrotreated naphtha stream is recovered from the vapor-liquid separator 62 in line 200 and delivered to line 500 for blending, preferably after dewatering (not shown). Line 500 may be a conduit that carries the second crude stream from line 499 that has been minimally processed or not processed. A hydrogen-rich dry gas stream is removed from the vapor-liquid separator in line 354. The dry gas in line 354 may be delivered to the fired heater 20 via line 210 and/or by line 96 to the CO boiler 90.

In an additional embodiment, shown in FIG. 1, a portion of the dry gas stream may be optionally split off of line 354 in line 356 regulated by a control valve, compressed in compressor 358 and recycled in line 360 to line 340 feeding the naphtha to the hydrotreating reactor 60. The recycle gas compressor may increase the average hydrogen purity in the hydrotreating reactor 60 and further increase catalyst life.

Blended Product

As shown in FIG. 1, the separate conversion products; hydrotreated naphtha and lighter products in line 200, LCO in line 202 and optionally heavy naphtha in line 201 are combined in line 500 where they combine with minimally processed or unprocessed second crude stream from line 499, thus forming a blended stream 502, or a synthetic product. The second crude stream may be supplied directly from the oilfield, but more preferably may be stripped to remove light hydrocarbons and dewatered. In an alternate embodiment, a portion of one or more of the conversion products is taken off as a side-product and further treated or processed as a saleable commodity. If this option is desired, a greater portion of the feed will need to be processed in the FCC riser 40 to make up for a loss of low viscosity material for blending.

Liquid products may include bottoms, light cycle oil, hydrotreated naphtha, and perhaps unhydrotreated heavy naphtha and the portions of each one may be selected to combine with the unprocessed crude to achieve desired flow properties. The minimally or unprocessed second crude stream may be a portion of the crude source that was not FCC processed. Specifically, all liquid streams may be combined with the second crude stream. The blended stream in line 502 may have the following characteristics, about 18 API or greater, preferably at least about 19 API, more preferably greater than about 19.5 API. The blended stream may have a viscosity at about 100° F. (about 38° C.) of no more than about 10,000 cSt, preferably no more than about 5000 cSt, and more preferably no more than about 25 cSt. The blended stream may also have a pour point of no more than about 20° C., preferably no more than about 15° C., and more preferably no more than about 0° C. The blended stream may then be pumped in a pipeline 502 to a remote location for further processing such as in a refinery or a distribution station. A remote location is typically greater than 20 miles away from the well in the oil field 1.

Catalyst Regeneration

As shown in FIG. 1, the spent catalyst separated from products by cyclones 52 fall downwardly into a bed and are stripped of hydrocarbons by steam in stripper 54 and delivered via spent catalyst conduit 55 regulated by a valve to a regenerator 70 in downstream communication with the reactor vessel 50. In the regenerator, 70 coke is burned off of the surface of the spent catalyst to produce a fresh or regenerated catalyst. Air is pumped from line 72 by blower 73 and enters the bottom of regenerator 70 to burn the coke at a temperature of between about 900° and about 1600° F. (between about 482° and about 871° C.), preferably between about 1000° and about 1400° F. (between about 538° and about 760° C.), more preferably between about 12000 and about 1300° F. (between about 649° and about 704° C.). Regenerator 70 may regenerate catalyst at between about 1100° and about 1500° F. (between about 593° and about 896° C.), preferably between about 1200° and about 1400° F. (preferably between about 649° and about 760° C.), more preferably between about 1220° and about 1350° F. (between about 660° and about 732° C.).

After the coke has been substantially burned off, the spent catalyst becomes regenerated catalyst again. The carbon that has been burned off makes up regeneration flue gas containing $H_2$, CO, $CO_2$, and light hydrocarbons. Cyclones 75 separate regenerated catalyst from the regeneration flue gas. Regenerated catalyst may be returned to riser 40 in downstream communication with the regenerator vessel 70 via regenerated catalyst conduit 74 to contact incoming crude feed in line 32.

The regeneration flue gas may be carried out of regenerator 70 by flue line 56 and into CO boiler 90. The $CO/CO_2$ ratio in the regeneration flue gas in stream 56 may be between about 0.3:1 and about 1.5:1,preferably between about 0.7:1 and about 01.25:1, more preferably about 1:1. Running regenerator 70 in partial burn is most appropriate for use with heavy residuals where regenerator heat release and air consumption are high due to high coke yield. In addition, oxygen-lean regeneration offers improved catalyst activity maintenance at high catalyst vanadium levels, due to reduced vanadium mobility at lower oxygen levels. By running regenerator 70 in deep partial burn to maximize the CO yield the unit will limit the amount of heat that could be released if the carbon were allowed to completely burn to $CO_2$. This will lower the regenerator temperature and permit a higher catalyst to oil ratio.

The heating value of the CO-containing gas may be low due to dilution with much nitrogen, therefore for efficient burning an auxiliary fuel such as dry gas is optionally injected in line 96 with air in line 95 to promote combustion and heat the burning zone to a temperature at which substantially all CO is oxidized to $CO_2$ in CO boiler 90. In the CO boiler 90 the regeneration flue gas reaches temperatures of at least about 1500° F. (about 815° C.), preferably at least about 1700° F. (about 926° C.), and more preferably at least about 1800° F. (about 982° C.). The combustion in the CO boiler 90 heats and vaporizes water fed by water line 99 to generate high pressure superheated steam which leaves CO boiler through steam line 101 for use in the FCC complex. The regeneration flue gas containing $CO_2$ leaves the CO boiler 90 and is released to the stack 102. An alternative auxiliary fuel may comprise clarified oil diverted from line 203 in line 205.

In addition to running the regenerator 70 in deep partial burn, additional heat may be removed from the regenerator 70 through the operation of a catalyst cooler on the regenerator 70. The regenerator may be equipped with between about 1 and about 5 catalyst coolers, more preferably about 2 and about 4 catalyst coolers 71, and more preferably about 3 catalyst coolers. Catalyst coolers may remove heat through steam generation. The steam from the catalyst coolers 71 may be delivered via line 94 to the CO boiler 90 to be superheated in the CO boiler.

Debutanizer

In a further embodiment, the naphtha stream may be directed to a debutanizer to form liquefied petroleum gas (LPG) and gasoline. The LPG and the gasoline may be added to the unprocessed crude, in selected amounts to achieve desired flow properties. The ability to modify the relative amounts of light hydrocarbons (propane through pentane) in the blended pipeline crude is advantageous because it may be held in tankage and therefore subjected to a still further specification of Reid vapor pressure (RVP) to minimize the boil-off of material at ambient conditions which may violate environmental regulations, cause material loss to flaring or require expensive vapor recovery systems. LPG addition to the unprocessed crude must be gauged to balance vapor pressure and flow properties.

Figure 2:
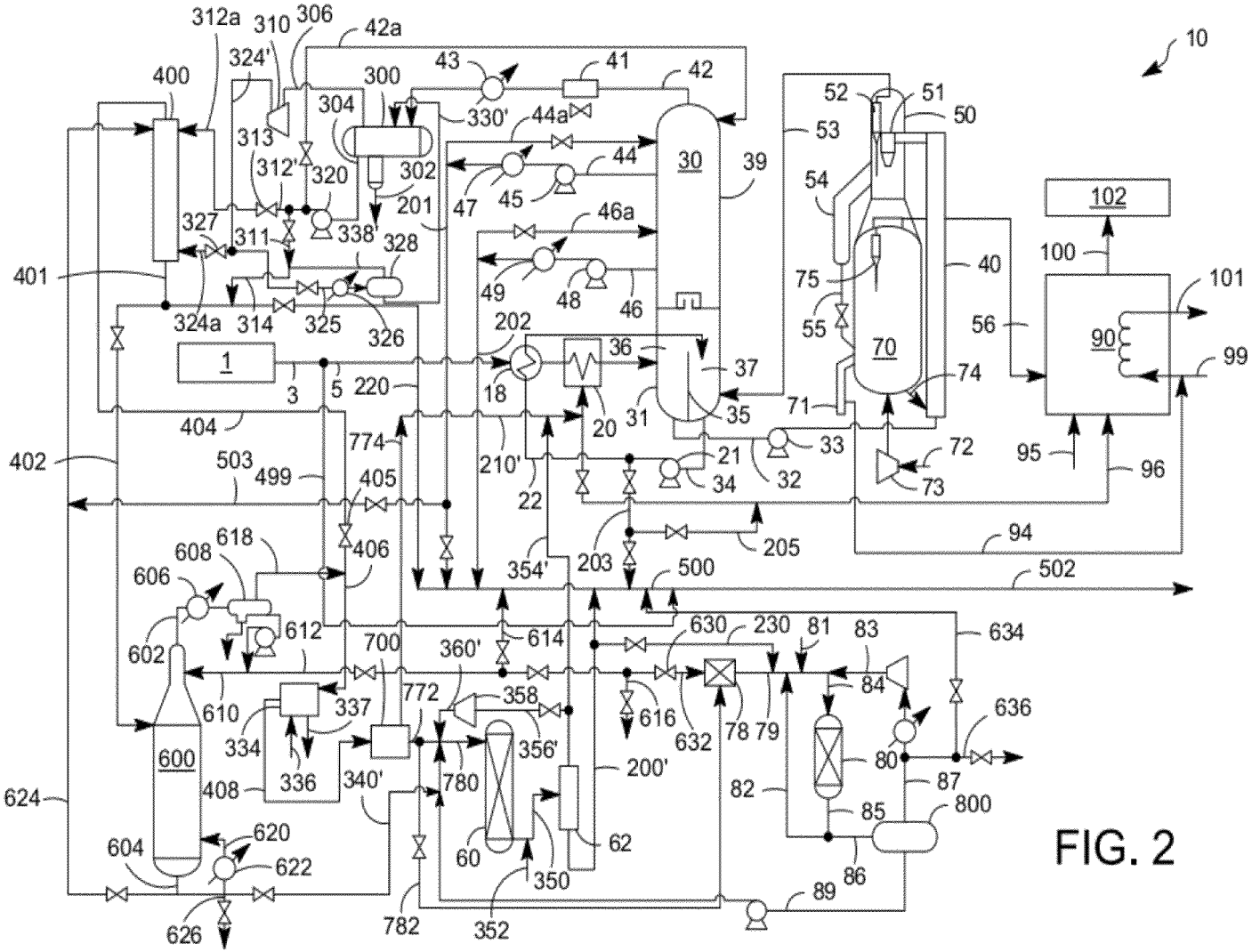
FIG. 2 is a flow scheme showing an alternative the process and apparatus of the present invention.

The embodiment of FIG. 2 includes a debutanizer 600 in downstream communication with the fractionator 30 to separate naphtha from the LPG and lighter material stream. Many of the elements in FIG. 2 have the same configuration as in FIG. 1 and bear the same reference number. Elements in FIG. 2 that correspond to elements in FIG. 1 but have a different configuration bear the same reference numeral as in FIG. 1 but are marked with a prime symbol ('). Every element upstream of the compressor 310 and pump 320 is the same as in FIG. 1 and the foregoing description is applicable in FIG. 2. FIG. 2 does not show the heavy naphtha cut and pump around with line 44, pump 45, steam generator 47 and line 44a in phantom as in FIG. 1. The naphtha and lighter hydrocarbons stripped from the crude oil may leave upper portion 39 of fractionator 30 in line 42. It is also contemplated in this embodiment that full range naphtha be withdrawn in line 42 without heavy naphtha being separately withdrawn in line 44. However, the embodiment will be described with only the light naphtha product boiling at or below about 135° to about 177° C. (275° to 350° F.) being withdrawn in line 42 and heavy naphtha withdrawn in line 44. The naphtha portion of the cracked stream in line 42 may be condensed by a condenser 41 and an optional boiler feed water heater 43 before it is directed to overhead receiver 300. Water is decanted from the receiver 300 in line 302 while vaporous wet gas is separated in line 306 from unstabilized naphtha liquid in line 304. The wet gas is pressurized in compressor 310 to the hydrotreating pressure previously mentioned. In an embodiment, the compressed wet gas stream in line 324' is diverted in line 325 because valve 327 is closed while the valve on line 325 is open. The compressed wet gas stream is then cooled in a heat exchanger 326 and flashed in a flash drum 328. A liquid stream from the flash drum 328 in line 330' is fed to the receiver 300 while a vapor stream is removed in line 338'. Unstabilized naphtha in line 304 is pumped by pump 320 in line 312'. Because valve 313 is closed and the valve on line 311 is open, line 311 diverts the stream into line 338' to provide a mixed stream in line 314. The stream in line 314 is split between line 402 which transports the mixed stream to a debutanizer column 600 and line 220 which may send naphtha to line 500 for blending. A portion of the unstabilized naphtha is refluxed to the fractionator column 30 via line 42*a*.

In the debutanizer column 600, a portion of the cracked stream comprising naphtha is subjected to fractionation to separate LPG from naphtha. Fractionation yields a $C_4$— overhead in overhead line 602 which is condensed in condenser 606 with the production of steam and dewatered in receiver 608. The condensed LPG is pumped and split between reflux line 610 which is returned to the debutanizer 600 and LPG line 612. The LPG line 612 feeds a blend line 614 which blends LPG with the processed products in line 500 and an optional product line 616 which recovers LPG as product which may be stored and/or sold locally. LPG is an excellent cutter component, but because of its high vapor pressure can be blended only up to the flash specification. Hence, the split between lines 610 and 612 and 614 and 616 should be set to maximize the LPG blended in line 500 up to the flash specification. Any excess can be captured and sold as LPG perhaps after further stripping of dry gas therefrom or used in the fired heater 20 or the CO boiler 90. A dry gas stream 618 from the receiver 608 may then be fed to a hydrogen purification unit 700 in downstream communication with the fractionator 30 and an overhead line 602 of the debutanizer 600. The dry gas stream in dry gas line 618 contains hydrogen and may be considered a hydrogen stream. The debutanizer column 600 also produces a bottoms stream in bottoms line 604 typically comprising $C_5$+ material. The bottoms stream 604 is split into several streams. A reboil line 620 is heated by reboiler 622 and returned to the debutanizer column 600. A naphtha feed stream in line 340' transports naphtha to the hydrotreating reactor 60 which is in downstream communication with the bottoms line 604 of the debutanizer 600. A portion of the naphtha stream may be split off in line 626 and recovered as product in line 626 to be stored and/or sold locally.

Absorber

An alternative embodiment, shown in FIG. 2, utilizes an absorber 400 in downstream communication with the fractionator 30 to separate a naphtha portion of the cracked stream into a $C_{3+}$ naphtha stream and a dry gas stream. The compressed wet gas in line 324' may continue on in line 324*a* through an open valve 327 and is fed to the bottom of the absorber 400 instead of proceeding in line 325 because the control valve on line 325 is closed. Similarly, the unstabilized liquid naphtha is pumped in line 312' which may continue on in line 312*a* through an open valve 313 to a top of the absorber 400 because the valve on line 311 is closed. In this embodiment which utilizes the absorber 400, streams in lines 324' and 312' are not combined and fed to the debutanizer via line 314 but are kept separate. In the absorber 400, the unstabilized liquid naphtha absorbs liquefied petroleum gas (LPG) from the wet gas and exits the absorber 400 in a bottoms line 401 comprising $C_3$+ naphtha. The absorbent line is split between product line 220 for delivering $C_3$+ to line 500 for blending and a debutanizer feed line 402. The debutanizer 600 is in downstream communication with the bottoms line 401 of the absorber 400 via line 402. Additionally, an optional naphtha recycle stream in line 624 from the bottoms of the debutanizer may be recycled to the absorber 400 to recover more LPG. In a further embodiment, a portion or all of the heavy naphtha in line 201 may be diverted via line 503 to the naphtha recycle line 624 to supplement the naphtha feed to the absorber 400 and increase the recovery of LPG in line 401. A dry gas stream with less LPG than in the wet gas in line 324 comprising $C_2$—, $H_2S$ and $H_2$ exit the absorber 400 in an overhead line 404. The dry gas stream in line 404 flows through an open control valve 405 to join dry gas stream 618 and provide combined dry gas stream in line 406. The dry gas streams in overhead line 404 and dry gas lines 618 and 406 contain hydrogen and may be considered hydrogen streams. Dry gas stream containing hydrogen is carried by dry gas line 406 to the hydrogen purification unit 700 in downstream communication with the overhead line 404 of the absorber 400.

Dry Gas Purification

In an embodiment, the hydrogen in the dry gas stream may be purified before it is used for hydrotreating to increase the hydrotreating catalyst life. Several types of hydrogen purification units may be suitable.

The dry gas in line 406 may be fed to an amine absorber 334 to remove hydrogen sulfide and carbon dioxide. A lean aqueous amine scrubbing solution is introduced into absorber 334 via line 336 and scrubs hydrogen sulfide and carbon dioxide from the dry gas stream. A rich aqueous amine scrubbing solution containing hydrogen sulfide is removed from absorber 334 via line 337 and is recovered and perhaps regenerated for recycle. A dry gas stream with a smaller concentration of hydrogen sulfide and carbon dioxide than in line 406 is removed from absorber 334 via line 408.

The dry gas stream in line 408 at a pressure determined by compressor 310 that will be adequate for hydrogen purification while sufficiently above dew point to maintain a gaseous state is fed to the hydrogen purification unit 700. The hydrogen purification unit 700 may be a pressure swing adsorption system 750 shown in FIG. 3. Other types of hydrogen purification units may be suitable. The pressure of the dry gas in line 408 may be between about 862 and about 2068 kPa (125 and 300 psia).

Figure 3:
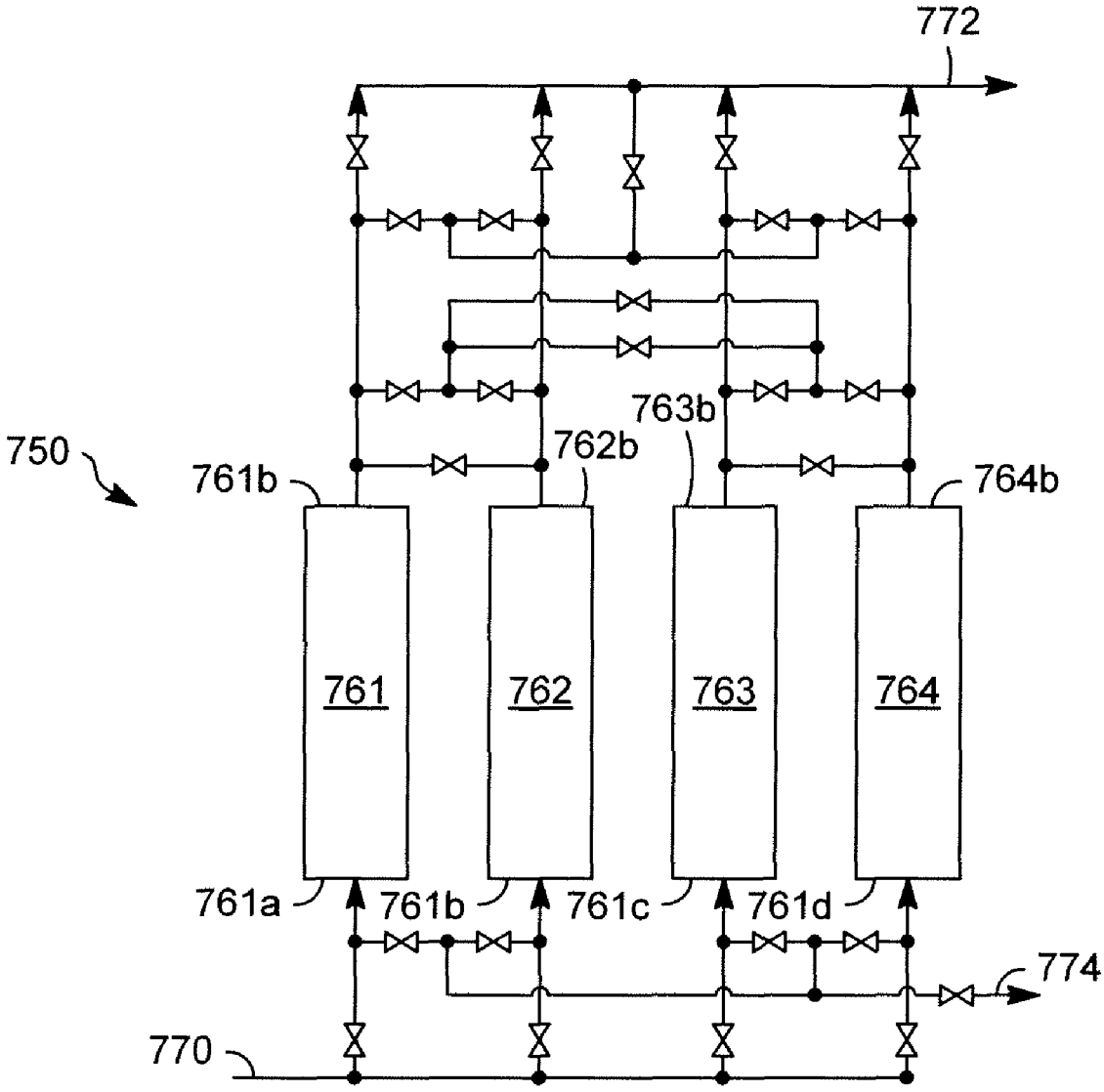
FIG. 3 is a flow scheme of a hydrogen purification unit.

In an embodiment, the hydrogen in the dry gas can be purified in a pressure swing adsorption (PSA) unit 750 shown in FIG. 3 to provide a hydrogen rich gaseous stream having a reduced concentration of carbon oxides, methane and ethane. The pressure swing adsorption process provides a well established means for separating and purifying hydrogen from a feed gas mixture of larger molecules. The process provides adsorption of the adsorbable species, such as carbon oxides, water and light hydrocarbon molecules, on an adsorbent at a high adsorption pressure with passage of the smaller hydrogen molecules and pressure reduction to a lower desorption pressure to desorb the adsorbed species. It is generally desirable to employ the PSA process in multiple bed systems such as those described in U.S. Pat. No. 3,430,418, herein incorporated by reference, in which at least four adsorption beds are employed. The PSA process is carried out in such systems on a cyclical basis, employing a processing sequence. Referring to FIG. 3, the PSA unit 750 may have four beds 761-764 having inlet ends 761*a*-764*a* and outlet ends 761*b*-764*b*. Valving is generally shown in FIG. 3. In the first step, the dry gas in line 770 in downstream communication with the dry gas line 408 is fed to an inlet end 761*a* of a first adsorbent bed 761 at high adsorption pressure to adsorb adsorbable species onto the adsorbent with passage of product hydrogen gas to a discharge end 761*b* of the bed 761. Purified hydrogen gas may pass from the PSA unit 750 through product line 772 with a greater hydrogen purity than in feed line 770. Feed flow is terminated to the first bed 761 before the carbon oxides, water and hydrocarbons break through to the discharge end 761*b* of the first bed. Second, the first bed 761 is cocurrently depressurized to an intermediate pressure by releasing void space gas from the discharge end 761*b* of the first bed to a discharge end 762*b* of a second bed 762 thereby repressurizing the second bed which has just been purged of desorbed carbon oxides, water and hydrocarbons. Further cocurrent depressurization of the first bed 761 can occur by releasing remaining void space gas to a discharge end 763*b* of a third bed 763 to purge the third bed of desorbed carbon oxides, water and hydrocarbons. In a third step, the inlet 761*a* to the first bed 761 is opened in a countercurrent depressurization or blow down step, in which gas departs the first bed through the inlet end 761*a* leaving the first bed 761 at sufficiently low pressure to desorb adsorbed species from the adsorbent. Desorbed species are released through the inlet 761 a and recovered in desorbent line 774 with a greater concentration of adsorbable species than in the feed line 770. In a fourth step, void space gas from a fourth bed 764 may be released through a discharge end 764*b* thereof and fed through the discharge end 761*a* of the first bed 761 to purge out the desorbed species. In a last step, void space gas from the second bed 762 is fed from its discharge end 762*b* into the discharge end 761*b* of the first bed 761 to repressurize the first bed. Product gas from the discharge end 763*b* of the third bed 763 is then fed into the discharge end 761*b* of the first bed 761 to achieve adsorption pressure in the first bed 761. Since the first bed 761 is now at adsorption pressure, the cycle in the first bed begins anew. The same process sequence is operated with the other beds 762-764, with differences relating to the position of the bed 762-764 in the order.

A suitable adsorbent may be activated calcium zeolite A with or without activated carbon. If this combination of adsorbents is used, the activated carbon will adsorb the carbon dioxide and water, while the zeolite A will adsorb the carbon monoxide and hydrocarbons.

Purified hydrogen with a hydrogen concentration greater than in dry gas line 408 is transported in line 772 which is in upstream communication with the hydrotreating reactor 60. The desorbent line 774 containing dry gas with a reduced concentration of hydrogen relative to the concentration in line 408 communicates with a waste dry gas line 210 which may be delivered to the fired heater 20 or to the CO boiler 90.

In the embodiment of FIG. 2, the $C_{5+}$ naphtha in line 340' is mixed with purified hydrogen in line 772 and introduced into the hydrotreating reactor 60 via line 780 to saturate the olefins and diolefins present therein. The hydrotreating reactor 60 is in downstream communication with the hydrogen purification unit 700. The resulting effluent from the hydrotreating reactor 60 in line 350 with a lower concentration of olefins than in the stream in line 340' is preferably contacted with an aqueous stream from line 352 to dissolve any ammonium salts and partially condense the hydrotreated effluent. The hydrotreated effluent in line 350 is then introduced into a high pressure vapor-liquid separator 62 operated at a pressure substantially equal to the hydrotreating reactor and a temperature in the range from about 38° C. (100° F.) to about 71° C. (160° F.). An aqueous hydrotreated naphtha stream is recovered from the vapor-liquid separator 62 in line 200' and delivered to line 500 for blending with the minimally processed or unprocessed second crude stream from line 499. A hydrogen-rich dry gas stream is removed from the vapor-liquid separator in line 354'. The dry gas in line 354' may be delivered to the fired heater 20 by line 210' and by line 96 to the CO boiler 90.

In an additional embodiment, shown in FIG. 2, at least a portion of the dry gas stream may be optionally split off of line 354' in line 356' regulated by a control valve, compressed in compressor 358 and recycled in line 360' to mix with purified hydrogen from line 772 and naphtha in line 340' to feed the hydrotreating reactor 60 via line 780.

Oligomerization

In an additional option, control valve 630 is opened to allow LPG in recovery line 612 to flow through line 632 to an oligomerization reactor 80. The olefin containing LPG stream in recovery line 632 has $C_3$ and $C_4$ olefins that can be oligomerized into heavier naphtha molecules. The diolefins in the LPG stream in line 632 are first reacted with a selective hydrogenation catalyst in selective hydrogenation zone 78 to selectively saturate diolefins without completely saturating them to paraffins. Hydrogen may be provided from the hydrogen purification zone 700 by line 782 diverging from hydrogen stream in line 772 regulated by a control valve. Suitable conditions for operation of a selective hydrogenation process are described, for example, in U.S. Pat. Nos. 6,166,279 and 6,075,173. Such conditions include passing the LPG stream in the liquid phase in the presence of hydrogen at molar ratio 0.5 to 5 moles hydrogen per mole of diolefin over a catalyst comprising at least one metal selected from the group formed by nickel, palladium and platinum, deposited on a support such as aluminum oxide, at a temperature of 20° to 200° C. (68° to 392° F.), a pressure of 689 to 3447 kPa(g) (100 to 500 psig), and a space velocity of 0.5 to 10 $hr^{-1}$. Two or more reaction zones may be used although only one is shown. Each reaction zone may employ a recycle of reactor effluent to the reactor inlet with a ratio of recycle to fresh olefinic feed stream ranging from 0 to 20. The residual diolefin content of such a process can be in the range 1 to 100 wppm, depending on the severity of the operation.

The LPG effluent from the selective hydrogenation reactor in line 79 with a diolefin concentration that is less than in line 632 may be mixed with none, one, some or all of a paraffinic diluent in line 230, a selectivity modifier that may enter through process line 81, an effluent recycle stream in recycle line 82 and a LPG recycle stream in line 83 to form an oligomerization reactor feed in feed line 84 that is then fed to a oligomerization reactor 80. The feed line 84 is in downstream communication with the overhead line 602 of the debutanizer 600 via line 632. The paraffinic diluent in line 230 may be a portion of hydrotreated naphtha from line 200'. In the oligomerization reactor 80, LPG is contacted with an oligomerization catalyst at oligomerization conditions to oligomerize the lighter olefins to produce heavier olefins in the naphtha range.

Conditions for the operation of a oligomerization process include passing the LPG liquid over a catalyst such as SPA or a sulfonic acid ion exchange resin such as Amberlyst A-15, A-35, A-16, A-36, Dowex 50 or the like. Several means can be used to restrict the formation of dodecene and higher oligomers. These include addition of a paraffinic diluent to the oligomerization reactor when SPA catalyst is used, recycle of a portion of the oligomerization reactor effluent to the oligomerization reactor feed stream and addition of 0.1 to 3.0 wt-% oxygenated selectivity modifier to the oligomerization reactor when resin catalyst is used. Since, this oligomerization may occur in the field where process streams are less available and because the process is only making cutter stock that will be refined at a downstream refinery, avoiding heavy olefin production is not critical. Additionally, if heavier oligomers are desired to conserve hydrogen in the hydrotreating reactor 60, none of the measures to avoid heavy oligomerization need be taken.

The preferred operating conditions applicable when an SPA catalyst is used differ from those when an ion exchange resin catalyst is used. Preferred temperatures for operation with an SPA catalyst are in the range 40° to 260° C., and more typically in the range 75° to 230° C., while preferred temperatures for operation with an ion-exchange resin catalyst are in the temperature range 0° to 200° C., and more typically in the range 40° to 150° C. Preferred pressures for operation with an SPA catalyst are in the range 689 to 8274 kPa(g) (100 to 1200 psig), and more typically in the range 1379 to 6895 kPa(g) (200 to 1000 psig), while preferred pressures for operation with an ionic resin catalyst are in the range 345 to 3447 kpa(g) (50 to 500 psig), and more typically in the range 1379 to 2413 kPa(g) (200 to 350 psig). These pressures may be kept in the lower end of the range, so an additional compressor is not required to boost the pressure above the system pressure needed for the hydrotreating reactor 70. A preferred space velocity range for operation with SPA catalyst is about 0.5 to about 5 $hr^{-1}$ and for operation with an ion-exchange resin catalyst is 0.3 to 20 $hr^{-1}$ depending on the properties of the oligomerization reactor feed such as olefin content and type.

An oligomerization reactor product is withdrawn from oligomerization reactor 80 through effluent line 85. A portion of the oligomerization reactor effluent may be recycled to the oligomerization reactor feed through recycle line 82 to control the exotherm. A second portion of the oligomerization reactor product is passed through process line 86 to a flash drum 800, in which an unreacted LPG vapor stream and an oligomerization product rich liquid stream are formed. The LPG vapor stream leaves flash drum 800 in vapor line 87 for further processing. A portion of vapor stream in line 87 may be recycled by line 83 to the oligomerization reactor 80 after condensing and compression while the remaining stream is processed through line 634 to be mixed with crude via line 500. A portion of the LPG may be recovered in line 636 if desired. The oligomerization product-rich liquid stream containing naphtha range molecules is sent through process line 89 to join naphtha in line 340' in route to the hydrotreating reactor 60 in downstream communication with effluent line 85 of the oligomerization reactor 80 to saturate the olefins.

It is also contemplated that if higher hydrogen requirements are necessary, that a steam reformer may be used to convert hydrocarbons in dry gas streams into hydrogen gas. All LPG and dry gas streams would be feed candidates to a steam reformer for hydrogen production.

EXAMPLE

We simulated the operation of the process of the present invention on the basis of charging 2,385 $m^3$/d (15,000 bbl/d) of crude to the FCC unit. The properties of the feed simulated are in Table 1.

TABLE 1

| | |
|---|---|
| API | 12.8 |
| UOP K | 11.4 |
| Nickel, wppm | 42.0 |
| Vanadium, wppm | 152.0 |
| Sulfur, wt-% | 1.28 |
| Conradson Carbon, wt-% | 12.88 |

The cracked stream from the FCC unit had the composition in Table 2 expressed in weight percentages.

TABLE 2

| | |
|---|---|
| Hydrogen Sulfide | 0.41 |
| Hydrogen | 0.44 |
| Methane | 1.00 |
| Ethylene | 0.86 |
| Ethane | 0.85 |
| Propylene | 3.40 |
| Propane | 0.96 |
| Butylenes | 4.44 |
| Isobutane | 1.72 |
| Normal Butane | 0.59 |
| Light Naphtha ($C_5$-164° C. (327° F.)) | 21.65 |
| LCO and Heavy Naphtha | 33.61 |

The properties of the light naphtha in the cracked stream are given in Table 3.

TABLE 3

| | |
|---|---|
| API | 62.9 |
| Sulfur, wt-% | 0.04 |
| Paraffins/Olefins/Naphthenes/ Aromatics, wt-% | 42/24/12/22 |
| Bromine Number | 39.8 |
| IBP/EP, ASTM, ° C. (° F.) | 46/164 (115/327) |

Case 1 is the embodiment of FIG. 2 with the valve 630 closed to the oligomerization zone and valves 313 and 327 closed to the absorber 400. The hydrogen production assumed that the PSA hydrogen purification unit would retain 86 wt-% of the hydrogen in dry gas feed. Additionally, all of the dry gas from the debutanizer is fed to the PSA unit. Table 4 gives the hydrogen balance for Case 1.

TABLE 4

| | |
|---|---|
| Hydrogen from PSA unit, kg/hr (lbs/hr) | 368 (812) |
| Naphtha hydrotreater demand, kg/hr (lbs/hr) | 255 (561) |
| Excess hydrogen, kg/hr (lbs/hr) | 114 (251) |

In Case 1, a surplus of hydrogen exists to saturate the olefins in the naphtha stream.

In Case 2, valve 630 is opened, so all of the LPG in line 612 is fed to the oligomerization reactor 80. Additionally, absorber 400 was utilized and all of the dry gas in the absorber overhead and the debutanizer overhead was fed to the PSA unit. Again, the hydrogen production assumed that the PSA hydrogen purification unit would retain 86 wt-% of the hydrogen in dry gas feed. Table 5 gives the hydrogen balance for Case 2.

TABLE 5

| | |
|---|---|
| Hydrogen from PSA unit, kg/hr (lbs/hr) | 368 (812) |
| Naphtha hydrotreater demand, kg/hr (lbs/hr) | 255 (561) |
| Additional naphtha hydrotreater demand for olefinic oligomers, kg/hr (lbs/hr) | 82 (181) |
| Selective hydrotreater demand, kg/hr (lbs/hr) | 3 (6) |
| Excess hydrogen, kg/hr (lbs/hr) | 29 (64) |

Even when additional hydrogen is required to saturate diolefins in the selective hydrotreater and to saturate the olefinic oligomers from the oligomerization reactor in the naphtha hydrotreater, the dry gas in the cracked stream still provides sufficient hydrogen to saturate all the olefins in the naphtha stream.

The existence of excess hydrogen indicates the naphtha cut point can be adjusted to allow heavier naphtha into the cracked stream in line 42. In both cases, the total olefinic concentration in line 500 is less than 0.1 wt-%. After the second crude stream is added to the first processed crude stream the olefin concentration will be decreased even further.

The invention claimed is:

1. An apparatus for improving flow properties of crude, comprising:

a riser charged with catalyst and having a bottom and a top, wherein a crude conduit delivers a first crude stream into said bottom and spent catalyst and a vaporized cracked stream exit from said top;

a vessel in downstream communication with said riser containing a cyclone for receiving and separating said vaporized cracked stream from said spent catalyst;

a fractionator in downstream communication with said vessel for receiving said vaporized cracked stream and fractionating a naphtha stream;

an absorber for scrubbing hydrogen sulfide from light ends downstream of the fractionator;

a hydrotreating reactor in downstream communication with said fractionator for receiving at least portion of said naphtha stream, said hydrotreating reactor also in communication with said absorber; and a conduit carrying a second crude stream in downstream communication with said hydrotreater for receiving a hydrotreated naphtha into said second crude stream.

2. The apparatus according to claim 1, including a debutanizer in downstream communication with said fractionator for receiving said naphtha stream.

3. The apparatus according to claim 1, including a hydrogen purification unit in downstream communication with said fractionator for receiving a dry gas stream.

4. The apparatus according to claim 3, wherein said hydrogen purification unit is in downstream communication with a debutanizer which is in downstream communication with said fractionator.

5. The apparatus according to claim 4, wherein said hydrogen purification unit is in downstream communication with an absorber which is in downstream communication with said fractionator.

6. The apparatus according to claim 5, wherein said debutanizer is in downstream communication with said absorber.

7. The apparatus according to claim 4, wherein said hydrogen purification unit is in downstream communication with an overhead line of said debutanizer.

8. The apparatus according to claim 5, wherein said hydrogen purification unit is in downstream communication with an overhead line of said absorber.

9. The apparatus according to claim 6, wherein said debutanizer is in downstream communication with a bottoms of said absorber.

10. The apparatus according to claim 3, wherein said hydrotreating reactor is in downstream communication with said hydrogen purification unit.

11. The apparatus according to claim 4, wherein said hydrotreating reactor is in downstream communication with a bottoms of said debutanizer.

12. The apparatus according to claim 11, wherein a feed line to an oligomerization unit is downstream from said debutanizer.

13. The apparatus according to claim 12, wherein said hydrotreating reactor is in downstream communication with an effluent line from said oligomerization reactor.

14. The apparatus according to claim 1 further comprising an additional absorber in downstream communication with said fractionator to separate the naphtha stream into $C_{3+}$ naphtha stream and a dry gas stream.

15. An apparatus for improving flow properties of crude, comprising:

a riser charged with catalyst and having a bottom and a top, wherein a crude conduit delivers a first crude stream into said bottom and an outlet withdraws spent catalyst and a vaporized cracked stream from said top;

a vessel in downstream communication with said outlet containing a cyclone for receiving and separating said vaporized cracked stream from said spent catalyst;

a regenerator in downstream communication with said vessel for receiving and regenerating said spent catalyst;

said riser in downstream communication with said regenerator for delivering regenerated catalyst to said riser;

a fractionator in downstream communication with said vessel for receiving said vaporized cracked stream and fractionating a naphtha stream and an LCO stream;

a hydrogen purification unit in downstream communication with said fractionator for receiving a dry gas stream to provide a purified hydrogen stream;

a hydrotreating reactor in downstream communication with a naphtha line of said fractionator for receiving at least a portion of said naphtha stream and said hydrogen purification unit to receive said purified hydrogen stream as said sole source of hydrogen;

a conduit carrying a second crude stream in downstream communication with said hydrotreating reactor for receiving a hydrotreated naphtha into said second crude stream; and an LCO line from said fractionator bypassing said hydrotreating reactor and said conduit is in downstream communication with said LCO line for receiving an LCO stream into said second crude stream.

16. The apparatus according to claim 15, including a debutanizer in downstream communication with said fractionator for receiving said naphtha stream.

17. The apparatus according to claim 15, wherein said hydrogen purification unit is in downstream communication with an absorber which is in downstream communication with said fractionator.

18. The apparatus according to claim 15, wherein said hydrogen purification unit is in downstream communication with a debutanizer which is in downstream communication with said fractionator.

19. An apparatus for improving flow properties of crude, comprising:

a riser charged with catalyst and having a bottom and a top, wherein a crude conduit delivers a first crude stream into said bottom and an outlet withdraws spent catalyst and a vaporized cracked stream from said top;

a vessel in downstream communication with said outlet containing a cyclone for receiving and separating said vaporized cracked stream from said spent catalyst;

a fractionator in downstream communication with said vessel for receiving said vaporized cracked stream and fractionating a naphtha stream;

an absorber for scrubbing hydrogen sulfide from light ends downstream of the fractionator;

an additional absorber in downstream communication with said fractionator to separate the naphtha stream into $C_{3+}$ naphtha stream and a dry gas stream;

a hydrogen purification unit in downstream communication with said fractionator for receiving the dry gas stream;

a hydrotreating reactor in downstream communication with said fractionator for receiving at least portion of said naphtha stream, said absorber and said hydrogen purification unit for receiving purified hydrogen; and a conduit carrying a second crude stream in downstream communication with said hydrotreating reactor for receiving a hydrotreated naphtha into said second crude stream.

20. The apparatus according to claim 19, wherein said hydrogen purification unit is in downstream communication with a debutanizer which is in downstream communication with said fractionator.

* * * * *